US012606881B2

(12) United States Patent
Jang et al.

(10) Patent No.: US 12,606,881 B2
(45) Date of Patent: Apr. 21, 2026

(54) HIGH TOUGHNESS HIGH CARBON COLD ROLLED STEEL SHEET HAVING EXCELLENT FORMABILITY, AND METHOD FOR MANUFACTURING SAME

(71) Applicant: POSCO CO., LTD, Pohang-si (KR)

(72) Inventors: Je-Wook Jang, Pohang-si (KR); Hak-Jun Kim, Pohang-si (KR); Sun-Mi Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 391 days.

(21) Appl. No.: 18/268,549

(22) PCT Filed: Dec. 10, 2021

(86) PCT No.: PCT/KR2021/018742

§ 371 (c)(1),
(2) Date: Jun. 20, 2023

(87) PCT Pub. No.: WO2022/139282

PCT Pub. Date: Jun. 30, 2022

(65) Prior Publication Data

US 2024/0018621 A1 Jan. 18, 2024

(30) Foreign Application Priority Data

Dec. 21, 2020 (KR) ..... 10-2020-0179991

(51) Int. Cl.

| | |
|---|---|
| ***C21D 9/46*** | (2006.01) |
| ***C21D 1/18*** | (2006.01) |
| ***C21D 1/32*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/18*** | (2006.01) |

(52) U.S. Cl.

CPC ..... *C21D 9/46* (2013.01); *C21D 1/18* (2013.01); *C21D 1/32* (2013.01); *C21D 6/002* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 8/0268* (2013.01); *C22C 38/002* (2013.01); *C22C 38/008* (2013.01); *C22C 38/02* (2013.01); *C22C 38/04* (2013.01); *C22C 38/06* (2013.01); *C22C 38/18* (2013.01); *C21D 2211/001* (2013.01); *C21D 2211/002* (2013.01); *C21D 2211/005* (2013.01); *C21D 2211/008* (2013.01)

(58) Field of Classification Search

CPC ... C21D 9/46; C21D 1/18; C21D 1/32; C21D 6/002; C21D 6/005; C21D 6/008; C21D 8/0205; C21D 8/0226; C21D 8/0236; C21D 8/0263; C21D 8/0268; C21D 2211/001; C21D 2211/002; C21D 2211/005; C21D 2211/008; C21D 1/20; C21D 8/0273; C22C 38/002; C22C 38/008; C22C 38/02; C22C 38/04; C22C 38/06; C22C 38/18

USPC ..... 148/652

See application file for complete search history.

(56) References Cited

U.S. PATENT DOCUMENTS

| | | | | |
|---|---|---|---|---|
| 2015/0047746 | A1* | 2/2015 | Iwatsu | C22C 38/04 148/111 |
| 2015/0118098 | A1 | 4/2015 | Vails | |
| 2016/0273067 | A1* | 9/2016 | Monden | C22C 38/008 |

FOREIGN PATENT DOCUMENTS

| | | | |
|---|---|---|---|
| EP | 3 072 986 | A1 | 9/2016 |
| EP | 3 072 987 | A1 | 9/2016 |
| JP | 07-179936 | A | 7/1995 |
| JP | 2000-144311 | A | 5/2000 |
| JP | 2015-521235 | A | 7/2015 |
| JP | 2018-048374 | A | 3/2018 |
| KR | 10-0847045 | B1 | 7/2008 |
| KR | 10-2012-0074798 | A | 7/2012 |
| KR | 10-2014-0044925 | A | 4/2014 |
| KR | 10-2016-0071462 | A | 6/2016 |
| WO | 2013/035848 | A1 | 3/2013 |

OTHER PUBLICATIONS

Extended European Search Report issued Apr. 3, 2024 in European Application No. 21911349.5.

International Search Report of PCT/KR2021/018742 dated Apr. 20, 2022 [PCT/ISA/210].

* cited by examiner

*Primary Examiner* — Danielle M. Carda

(74) *Attorney, Agent, or Firm* — Sughrue Mion, PLLC

(57) ABSTRACT

One embodiment of the present invention provides: a high toughness high carbon cold rolled steel sheet having excellent formability comprising, by weight %, C: 0.80% to 1.25%, Mn: 0.2% to 0.6%, Si: 0.01% to 0.4%, P: 0.005% to 0.02%, S: 0.01% or less, Al: 0.01% to 0.1%, Cr: 0.01% to 1.0%, Sn: 0.05% to 0.5%, the remainder being Fe and other unavoidable impurities, in which a microstructure includes, by area %, retained austenite: 1% to 10%, martensite: 1% to 10%, ferrite: 5% or less (including 0%), the remainder being bainite, and has an average grain size of 3 μm to 20 μm, and an internal oxide layer formed directly below the surface has a thickness of 10 μm or less; and a method for manufacturing same.

12 Claims, No Drawings

HIGH TOUGHNESS HIGH CARBON COLD ROLLED STEEL SHEET HAVING EXCELLENT FORMABILITY, AND METHOD FOR MANUFACTURING SAME

CROSS REFERENCE TO RELATED APPLICATIONS

This application is a National Stage of International Application No. PCT/KR2021/018742, filed Dec. 10, 2021, claiming priority to Korean Patent Application No. 10-2020-0179991, filed Dec. 21, 2020, the entire disclosures of which are incorporated herein by reference, the entire disclosures of which are incorporated herein by reference.

TECHNICAL FIELD

The present disclosure relates to a high-toughness high-carbon cold-rolled steel sheet having excellent formability and a method for manufacturing the same.

BACKGROUND ART

High-carbon hot-rolled steel has been widely applied to parts for automobiles such as engines, transmissions, and automobile doors and seats, and parts for industrial tools such as saws and knives, and a thickness of a final product to which the high-carbon hot-rolled steel is applied ranges from 0.15 mm to 6.0 mm or more depending on the purpose. Such high-carbon hot-rolled steel is manufactured as a final product through annealing/cold rolling processes, and a method for manufacturing a thin high-carbon steel part having a thickness of 2.0 mm or less is slightly more complicated than a thick part, and the thin high-carbon steel part is mainly applied to high-quality materials such as high-end products. When the high-carbon hot-rolled steel is applied to such high-quality materials, manufacturing costs increase as annealing/cold rolling are repeated 2 or 3 times and patenting heat treatment (austempering) is also applied.

Meanwhile, high-carbon steel is subjected to a quenching & tempering (QT) heat treatment process to manufacture a final product, but in this case, temper brittleness may occur, and at this time, in a case of a thin material having a thickness of 2.0 mm or less, there is a high risk of the occurrence of temper brittleness.

DISCLOSURE

Technical Problem

An aspect of the present disclosure is to provide a high-toughness high-carbon cold-rolled steel sheet having excellent formability and a method for manufacturing the same.

Technical Solution

According to an aspect of the present disclosure, a high-toughness high-carbon cold-rolled steel sheet having excellent formability includes, by wt %: 0.80 to 1.25% of C, 0.2% to 0.6% of Mn, 0.01 to 0.4% of Si, 0.005 to 0.02% of P, 0.01% or less of S, 0.01 to 0.1% of Al, 0.01 to 1.0% of Cr, 0.05% to 0.5% of Sn, and a balance of Fe and other unavoidable impurities, wherein a microstructure includes, by area %, 1 to 10% of retained austenite, 1 to 10% of martensite, 5% or less (including 0%) of ferrite, and a balance of bainite, an average grain size of the microstructure is 3 to 20 μm, and a thickness of an internal oxide layer formed directly below a surface of the cold-rolled steel sheet is 10 μm or less.

According to another aspect of the present disclosure, a method for manufacturing a high-toughness high-carbon cold-rolled steel sheet having excellent formability includes: heating a slab including, by wt %: 0.80 to 1.25% of C, 0.2 to 0.6% of Mn, 0.01 to 0.4% of Si, 0.005 to 0.02% of P, 0.01% or less of S, 0.01 to 0.1% of Al, 0.01 to 1.0% of Cr, 0.05 to 0.5% of Sn, and a balance of Fe and other unavoidable impurities, rough-rolling the heated slab to obtain a bar; finish-rolling the bar at 850 to 950° C. to obtain a hot-rolled steel sheet; cooling the hot-rolled steel sheet to 560 to 700° C. and then coiling the cooled hot-rolled steel sheet; subjecting the coiled hot-rolled steel sheet to primary cold rolling to obtain a cold-rolled steel sheet; subjecting the cold-rolled steel sheet to spheroidizing annealing at 650 to 740° C. for 10 to 25 hours; subjecting the spheroidized-annealed cold-rolled steel sheet to secondary cold rolling; reheating the cold-rolled steel sheet subjected to the secondary cold rolling at 800 to 1,000° C. for 10 to 120 seconds; and quenching the reheated cold-rolled steel sheet to 300 to 500° C. and then maintaining the quenched cold-rolled steel sheet for 30 to 180 seconds.

Advantageous Effects

According to an aspect of the present disclosure, it is possible to provide a high-toughness high-carbon cold-rolled steel sheet having excellent formability and a method for manufacturing the same.

BEST MODE FOR INVENTION

Hereinafter, a high-toughness high-carbon cold-rolled steel sheet having excellent formability according to an exemplary embodiment in the present disclosure will be described. First, an alloy composition of the high-carbon cold-rolled steel sheet according to the present disclosure will be described. Unless specifically stated otherwise, a content of the alloy composition described below refers to "wt %".

C: 0.80 to 1.25%

Carbon (C) is an element affecting strength, toughness, and microstructure formation. When a content of C is lower than 0.80%, a ferrite phase is formed in hot-rolled steel, and thus, a strain hardening rate is reduced during cold rolling before annealing (full-hard), which is disadvantageous in securing strength. On the other hand, when the content of C exceeds 1.25%, cracks may occur during cold rolling before annealing due to formation of pro-eutectoid cementite. Therefore, the content of C is preferably within a range of 0.80 to 1.25%. A lower limit of the content of C is more preferably 0.82%, still more preferably 0.84%, and most preferably 0.86%. An upper limit of the content of C is more preferably 1.23% and still more preferably 1.20%.

Mn: 0.2 to 0.6%

Manganese (Mn) is a solid solution strengthening element and is added to increase strength and secure hardenability. When a content of Mn is less than 0.2%, that is, when the amount of Mn is small, it may be difficult to secure a strength of 1,600 MPa or more. On the other hand, when the content of Mn exceeds 0.6%, toughness is deteriorated due to segregation/inclusion formation. Therefore, the content of Mn is preferably within a range of 0.2 to 0.6%. A lower limit of the content of Mn is more preferably 0.22%, still more preferably 0.25%, and most preferably 0.3%. An upper limit of the content of Mn is more preferably 0.55%, still more preferably 0.53%, and most preferably 0.5%.

Si: 0.01 to 0.4%

Silicon (Si) is added for solid solution strengthening and suppression of scale defects during hot rolling. When a content of Si is less than 0.01%, it may be difficult to sufficiently obtain the effects described above. On the other hand, when the content of Si exceeds 0.4%, formation of excessive primary scale may cause red scale defects, which may inhibit a heat treatment and formability. Therefore, the content of Si is preferably within a range of 0.01 to 0.4%. A lower limit of the content of Si is more preferably 0.02%, still more preferably 0.04%, and most preferably 0.05%. An upper limit of the content of Si is more preferably 0.35%, still more preferably 0.30%, and most preferably 0.25%.

P: 0.005 to 0.02%

Phosphorus (P) is an element having the greatest solid solution strengthening effect. In order to secure strength, it is preferable to add 0.005% or more of P, but when a content of P exceeds 0.02%, formability is deteriorated due to P segregation. Therefore, the content of P is preferably within a range of 0.005 to 0.02%. A lower limit of the content of P is more preferably 0.006%, still more preferably 0.007%, and most preferably 0.008%. An upper limit of the content of P is more preferably 0.018%, still more preferably 0.016%, and most preferably 0.015%.

S: 0.01% or Less

Sulfur (S) is an element that easily forms non-metallic inclusions and is an impurity that increases the amount of precipitates, and therefore, it is required to manage the amount of S to be as low as possible. In the present disclosure, a content of S is controlled to 0.01% or less. Meanwhile, in the present disclosure, the lower the content of S, the less the risk of brittleness due to segregation/inclusions, which is advantageous in securing toughness. Therefore, a lower limit thereof is not particularly limited. The content of S is more preferably 0.008% or less, still more preferably 0.006% or less, and most preferably 0.005% or less.

Al: 0.01 to 0.1%

Aluminum (Al) is added not only for deoxidation, but also for refinement of a bainite or martensite structure finally obtained through refinement of austenite grains by AlN formation. When a content of Al is less than 0.01%, it is difficult to sufficiently obtain the effects described above, and when the content of Al exceeds 0.1%, an excessive increase in strength and slab defects during continuous casting may occur. Therefore, the content of Al is preferably 0.01% to 0.1%. A lower limit of the content of Al is more preferably 0.015%, still more preferably 0.017%, and most preferably 0.02%. An upper limit of the content of Al is more preferably 0.08%, still more preferably 0.06%, and most preferably 0.05%.

Cr: 0.01 to 1.0%

Chromium (Cr) is preferably added in an amount of 0.1% or more to secure solid solution strengthening and hardenability. On the other hand, when the content of Cr exceeds 1.0%, toughness may be deteriorated due to segregation and formation of excessive carbides, and undissolved carbides remain. Therefore, the content of Cr is preferably within a range of 0.1 to 1.0%. A lower limit of the content of Cr is more preferably 0.05%, still more preferably 0.07%, and most preferably 0.1%. An upper limit of the content of Cr is more preferably 0.9%, still more preferably 0.8%, and most preferably 0.7%.

Sn: 0.05 to 0.5%

Tin (Sn) is segregated in a surface layer portion to suppress Mn or Cr oxide layer formation, such that formation of an internal oxide layer is suppressed. That is, Sn is an element that prevents formability defects by suppressing formation of an internal oxide layer of a surface layer portion generated during manufacturing of hot-rolled steel and a subsequent heat treatment process. When a content of Sn exceeds 0.05%, it is difficult to sufficiently obtain the effects described above. On the other hand, when the content of Sn exceeds 0.5%, formability defects may occur due to excessive segregation. Therefore, the content of Sn is preferably within a range of 0.05 to 0.5%. A lower limit of the content of Sn is more preferably 0.07%, still more preferably 0.09%, and most preferably 0.1%. An upper limit of the content of Sn is more preferably 0.45%, still more preferably 0.43%, and most preferably 0.4%.

In addition to the steel composition described above, a balance of Fe and unavoidable impurities may be included. The unavoidable impurities may be unintentionally incorporated in a common steel manufacturing process and may not be excluded completely, and the meaning may be easily understood by those skilled in the steel manufacturing field. In addition, the present disclosure does not completely exclude addition of a composition other than the steel composition described above.

Hereinafter, a microstructure of the high-carbon cold-rolled steel sheet according to the present disclosure will be described.

It is preferable that a microstructure of the high-carbon cold-rolled steel sheet according to the present disclosure includes, by area %, 1 to 10% of retained austenite, 1 to 10% of martensite, 5% or less (including 0%) of ferrite, and a balance of bainite. In the present disclosure, bainite is included as a matrix structure, such that it is possible to secure excellent toughness and at the same time to reduce the risk of temper brittleness. The retained austenite is mostly generated in the vicinity of a triple point on the microstructure, and increases an elongation, such that an effect of improving toughness is exhibited. When a fraction of the retained austenite is less than 1%, it is difficult to sufficiently obtain the effects described above, and when the fraction of the retained austenite exceeds 10%, transformation into a martensite phase occurs due to a TRIP phenomenon after processing caused by formation of needle-like retained austenite, which may cause cracks. An upper limit of the fraction of the retained austenite is more preferably 9%, still more preferably 8%, and most preferably 7%. The martensite is a structure that helps to secure high strength. When a fraction of the martensite is less than 1%, it is difficult to sufficiently obtain the effects described above, and when the fraction of the martensite exceeds 10%, a difference in hardness between phases with the bainite structure is increased, which may cause deterioration of formability. An upper limit of the fraction of the martensite is more preferably 8%, still more preferably 7%, and most preferably 5%. Meanwhile, in the present disclosure, ferrite may be formed inevitably in the manufacturing process. The ferrite increases a difference in hardness between phases with hard phases such as bainite and martensite, which may cause deterioration of formability. Therefore, it is preferable to suppress formation of ferrite as much as possible, and an upper limit of a fraction of the ferrite is limited to 5%. The upper limit of the fraction of the ferrite is more preferably 4%, still more preferably 3%, and most preferably 2%. Meanwhile, the bainite and martensite may include tempered bainite and tempered martensite, respectively.

An average grain size of the microstructure is preferably 3 to 20 μm to secure strength and bendability. When the average grain size of the microstructure is less than 3 μm, a retained austenite phase is excessively formed at the triple point, which may cause deterioration of bendablity, and when the average grain size of the microstructure exceeds 20 μm, strength may be reduced. A lower limit of the average grain size of the microstructure is more preferably 4 μm, still more preferably 5 μm, and most preferably 6 μm. An upper limit of the average grain size of the microstructure is more preferably 18 μm, still more preferably 16 μm, and most preferably 15 μm.

In the high-carbon cold-rolled steel sheet according to the present disclosure, a thickness of an internal oxide layer formed directly below a surface of the cold-rolled steel sheet is preferably 10 μm or less to secure formability. The internal oxide layer means that Mn, Cr, or the like combines with oxygen to form an oxide and the oxide is present along a grain boundary of a structure of the surface portion. In addition to Mn and Cr, elements having a high oxide formation ability through combination with oxygen may form the internal oxide layer. Such an internal oxide layer causes deterioration of the material of the surface portion, which may cause deterioration of formability such as cracks. In particular, when the thickness of the internal oxide layer exceeds 10 μm, cracks occur at the surface portion, which may cause serious formability defects. The thickness of the internal oxide layer is more preferably 8 μm or less, still more preferably 5 μm or less, and most preferably 3 μm or less.

The high-carbon cold-rolled steel sheet according to an exemplary embodiment in the present disclosure provided as described above may have a tensile strength of 1,600 to 2,000 MPa, a hardness of 47 to 54 HRC, and an R/t of 1.0 or less when measured in a 90° bending test, and thereby, excellent strength, hardness, and formability may be secured simultaneously. Here, R represents a minimum bending radius (mm) at which cracks do not occur after the 90° bending test, and t represents a thickness (mm) of the steel sheet. In addition, cracks do not occur in the high-carbon cold-rolled steel sheet of the present disclosure in a 180° bending test, and thus, the cold-rolled steel sheet of the present disclosure may have excellent toughness. In addition, the high-carbon cold-rolled steel sheet of the present disclosure may have a thickness of 0.4 to 2.0 mm. Meanwhile, the 180° bending test may be carried out by bending a steel material by 180° using a round bar having an R/t of 2.0.

Hereinafter, a method for manufacturing a high-carbon cold-rolled steel sheet according to the present disclosure will be described.

First, a slab that satisfies the alloy composition described above is heated. The heating of the steel slab may be performed at 1,100 to 1,300° C. When the heating temperature of the steel slab is lower than 1,100° C., it may be difficult to sufficiently secure the temperature of the slab required for threading, and when the heating temperature of the steel slab exceeds 1,300° C., surface defects may occur due to abnormal austenite growth and excessive scale. Therefore, the heating temperature of the slab is preferably within a range of 1,100 to 1,300° C. A lower limit of the heating temperature of the slab is more preferably 1,140° C., still more preferably 1,170° C., and most preferably 1,190° C. An upper limit of the heating temperature of the slab is more preferably 1,280° C., still more preferably 1,260° C., and most preferably 1,250° C.

Thereafter, the heated slab is subjected to rough-rolling to obtain a bar. The rough-rolling may be performed at 1,000 to 1,100° C. When the rough-rolling temperature is lower than 1,000° C., a rolling load is increased, which may cause deterioration of threading properties, and when the rough-rolling temperature exceeds 1,100° C., scale is excessively formed, which may cause significant deterioration of surface quality. Therefore, the rough-rolling temperature is preferably within a range of 1,000 to 1,100° C. A lower limit of the rough-rolling temperature is more preferably 1,020° C., still more preferably 1,030° C., and most preferably 1,040° C. An upper limit of the rough-rolling temperature is more preferably 1,090° C., still more preferably 1,080° C., and most preferably 1,070° C.

Thereafter, the bar is subjected to finish-rolling at 850 to 950° C. to obtain a hot-rolled steel sheet. When the finish-rolling temperature is lower than 850° C., hot rolling properties are greatly deteriorated due to an excessive rolling load, and when the finish-rolling temperature exceeds 950° C., a size of an austenite grain becomes significantly coarse, which may cause brittleness. Therefore, the finish-rolling temperature is preferably within a range of 850 to 950° C. A lower limit of the finish-rolling temperature is more preferably 855° C., still more preferably 860° C., and most preferably 870° C. An upper limit of the finish-rolling temperature is more preferably 940° C., still more preferably 940° C., and most preferably 930° C. Meanwhile, the hot-rolled steel sheet may have a thickness of 2.0 to 4.0 mm. In the case of high-end industrial/tool products, a thickness of the cold-rolled steel sheet is mainly 0.4 to 2.0 mm, and in order to satisfy the thickness of the cold-rolled steel sheet at a cold rolling reduction ratio of 60% or less, the thickness of the hot-rolled steel sheet is preferably within a range of 2.0 to 4.0 mm.

Thereafter, the hot-rolled steel sheet is cooled to 560 to 700° C. and then the cooled hot-rolled steel sheet is coiled. When the coiling temperature is lower than 560° C., a uniform hot-rolled structure may not be obtained because a bainite or martensite structure, which is a low-temperature transformation structure, appears. When the coiling temperature exceeds 700° C., an internal oxide layer and a decarburized layer are formed on the surface portion, which may cause surface defects. Therefore, the coiling temperature is preferably within a range of 560 to 700° C. A lower limit of the coiling temperature is more preferably 570° C., still more preferably 580° C., and most preferably 590° C. An upper limit of the coiling temperature is more preferably 690° C., still more preferably 680° C., and most preferably 670° C. The cooling may be performed at a cooling rate of 5 to 50° C./s. When the cooling rate is less than 5° C./s, a pearlite structure becomes coarse, and thus, there is a risk of occurrence of cracks during cold rolling before spheroidizing annealing, and when the cooling rate exceeds 50° C./s, cold rolling properties may be deteriorated due to coil shape defects such as wave generation caused by overcooling of an edge portion in a width direction. Therefore, the cooling rate is preferably within a range of 5 to 50° C./s. A lower limit of the cooling rate is more preferably 10° C./s, still more preferably 13° C./s, and most preferably 15° C./s. An upper limit of the cooling rate is more preferably 45° C./s, still more preferably 40° C./s, and most preferably 35° C./s.

After the coiling, pickling the coiled hot-rolled steel sheet at 200° C. or lower may be additionally included. As an example, cooling to the pickling temperature may be natural cooling. Scale formed on the surface of the steel sheet may be removed through the pickling. When the pickling temperature exceeds 200° C., the surface portion of the hot-rolled steel sheet is over-pickled, which may cause deterioration of roughness of the surface portion. The pickling temperature is preferably 200° C. or lower. In the present disclosure, a lower limit of the pickling temperature is not particularly limited, and may be, for example, room temperature.

Meanwhile, a microstructure of the hot-rolled steel sheet obtained by the process described above may include 90 area % or more of pearlite and a balance of bainite.

Thereafter, the coiled hot-rolled steel sheet is subjected to primary cold rolling to obtain a cold-rolled steel sheet (hereinafter, also referred to as an "unannealed cold-rolled steel sheet (full-hard steel)"). Through the primary cold rolling, a size of a pearlite block and an interlayer spacing between carbide layers may be further refined. A reduction ratio during the primary cold rolling may be 30 to 60%. When the reduction ratio during the primary cold rolling is less than 30%, a deviation in material in length direction/width direction may be caused, and when the reduction ratio during the primary cold rolling exceeds 60%, the strength is excessively increased, which may cause deterioration of cold rolling properties and occurrence of cracks in a width edge portion. Meanwhile, since detailed rolling pass schedule such as a reduction ratio and speed per individual pass during the cold rolling varies depending on equipment and usage, the present disclosure is not particularly limited to the above conditions. A thickness of the cold-rolled steel sheet obtained through the primary cold rolling may be 0.8 to 2.0 mm.

Thereafter, the cold-rolled steel sheet is subjected to spheroidizing annealing at 650 to 740° C. for 10 to 25 hours. The spheroidizing annealing is a process for softening the steel sheet for secondary cold rolling and forming fine spherical carbides. When the spheroidizing annealing temperature is lower than 650° C., spheroidization of carbides barely occurs, and when the spheroidizing annealing temperature exceeds 740° C., reverse-transformation of austenite occurs in some structures and pearlite recrystallization occurs, such that a spheroidized structure is not formed. Therefore, the spheroidizing annealing temperature is preferably within a range of 650 to 740° C. A lower limit of the spheroidizing annealing temperature is more preferably 660° C., still more preferably 670° C., and most preferably 680° C. An upper limit of the spheroidizing annealing temperature is more preferably 735° C., still more preferably 730° C., and most preferably 725° C. When the spheroidizing annealing time is shorter than 10 hours, spheroidization barely occurs, and when the spheroidizing annealing time exceeds 25 hours, the formed spherical carbide grows and becomes coarse, which may cause deterioration of heat treatment properties of austempering, which is a post-process. Therefore, the spheroidizing annealing time is preferably within a range of 10 to 25 hours. A lower limit of the spheroidizing annealing time is more preferably 11 hours, still more preferably 12 hours, and most preferably 14 hours. An upper limit of the spheroidizing annealing time is more preferably 24 hours, still more preferably 23 hours, and most preferably 22 hours.

Thereafter, the spheroidized-annealed cold-rolled steel sheet is subjected to secondary cold rolling. The secondary cold rolling is performed not only to secure a target final thickness, but also to refine the pearlite structure. A reduction ratio during the secondary cold rolling may be 30 to 50% considering a thickness of a final product.

Thereafter, the cold-rolled steel sheet subjected to the secondary cold rolling is subjected to an austempering heat treatment. The austempering heat treatment is performed to secure target physical properties by forming bainite as a main structure. The austempering heat treatment in the present disclosure is a process of reheating the cold-rolled steel sheet to an austenizing temperature, cooling the reheated cold-rolled steel sheet to a bainite formation temperature range, maintaining the cooled cold-rolled steel sheet at the corresponding temperature for a certain time to sufficiently form bainite, and then cooling the cold-rolled steel sheet to room temperature. More specifically, the austempering heat treatment process includes: reheating the cold-rolled steel sheet subjected to the secondary cold rolling at 800 to 1,000° C. for 10 to 120 seconds; and quenching the reheated cold-rolled steel sheet to 300 to 500° C. and then maintaining the quenched cold-rolled steel sheet for 30 to 180 seconds.

When the reheating temperature is lower than 800° C., the existing pearlite structure may remain, which may cause brittleness, or undissolved carbides may remain, which may cause defects, and when the reheating temperature exceeds 1,000° C., the austenite grain becomes coarse, which may cause deterioration of toughness. Therefore, the reheating temperature is preferably within a range of 800 to 1,000° C. A lower limit of the reheating temperature is more preferably 820° C., still more preferably 840° C., and most preferably 850° C. An upper limit of the reheating temperature is more preferably 970° C., still more preferably 950° C., and most preferably 930° C. When the reheating time is shorter than 10 seconds, austenizing does not occur completely, and when the reheating time exceeds 120 seconds, grains become coarse. Therefore, the reheating time is preferably within a range of 10 to 120 seconds. A lower limit of the reheating time is more preferably 15 seconds, still more preferably 18 seconds, and most preferably 20 seconds. An upper limit of the reheating time is more preferably 110 seconds, still more preferably 100 seconds, and most preferably 90 seconds. Meanwhile, in the present disclosure, the reheating method is not particularly limited, and for example, a high frequency induction heating or BOX type heating furnace may be used.

When the quenching end temperature is lower than 300° C., martensite is excessively formed, which may cause deterioration of toughness, and when the quenching end temperature exceeds 500° C., bainite is not sufficiently transformed, and a pearlite phase is excessively formed, which may make it difficult to secure strength. Therefore, the quenching end temperature is preferably within a range of 300 to 500° C. A lower limit of the quenching end temperature is more preferably 330° C., still more preferably 350° C., and most preferably 370° C. An upper limit of the quenching end temperature is more preferably 480° C., still more preferably 460° C., and most preferably 450° C. When the maintaining time is shorter than 30 seconds, it may be difficult to secure a sufficient fraction of bainite, and when the maintaining time exceeds 180 seconds, a fraction of retained austenite may increase, and thus, it may be difficult to obtain physical properties desired by the present disclosure. Therefore, the maintaining time is preferably within a range of 30 to 180 seconds. A lower limit of the maintaining time is more preferably 33 seconds, still more preferably 35 seconds, and most preferably 40 seconds. An upper limit of the maintaining time is more preferably 170 seconds, still more preferably 165 seconds, and most preferably 160 seconds.

Meanwhile, a cooling rate during the quenching may be 10 to 50° C./s. When the cooling rate during the quenching is less than 10° C./s, bainite may not be sufficiently formed. On the other hand, when the cooling rate during the quenching exceeds 50° C./s, quenching cracks may occur. A lower limit of the cooling rate during the quenching is more preferably 13° C./s, still more preferably 15° C./s, and most preferably 20° C./s. An upper limit of the cooling rate during the quenching is more preferably 45° C./s, still more preferably 40° C./s, and most preferably 35° C./s. Meanwhile, in the present disclosure, the quenching method is not particularly limited, and for example, oil at 100° C. or lower or water at 50° C. or lower may be used.

MODE FOR INVENTION

Hereinafter, the present disclosure will be described in more detail with reference to Examples. However, the following Examples are provided to illustrate and describe the present disclosure in more detail, but are not intended to limit the scope of the present disclosure.

EXAMPLES

Slabs having the alloy compositions shown in Table 1 were heated at 1,200° C. for 2 hours, and then hot-rolled steel sheets were manufactured below the conditions shown in Table 2. At this time, the rough-rolling temperature was 1,050° C., and the cooling rate from hot rolling to coiling was 25° C./s. Thereafter, a pickling process was performed, and then cold-rolled steel sheets were manufactured below the conditions shown in Tables 2 and 3. The microstructure, average grain size, internal oxide layer thickness, and mechanical properties of the cold-rolled steel sheets manufactured as described above were measured. The results thereof are shown in Table 4.

The type, fraction, and average grain size of the microstructure were measured using an electron microscope electron backscatter diffraction (EBSD) technique at a magnification of ×2,000.

A thickness of an internal oxide layer was measured by subjecting a surface portion of a cold-rolled steel sheet to nital etching, and then determining a region from a surface layer portion to a point where the pickled grain boundary was visible as the internal oxide layer using an electron micrograph at a magnification of ×2,000.

A tensile strength was measured by collecting a specimen of JIS-5 standard from the cold-rolled steel sheet, and then performing a tensile test.

As for a hardness, an HRC value was measured at a load of 150 kg with a Rockwell hardness C scale.

Bending properties were determined by performing a 90° bending test on the cold-rolled steel sheet and dividing a minimum bending radius R at which cracks did not occur by a thickness t of the cold-rolled steel sheet.

180° bending properties were evaluated by the presence or absence of cracks after performing a 180° bending test on the cold-rolled steel sheet using a round bar having an R/t=2.0. At this time, a case where cracks did not occur was expressed as O, and a case where cracks occurred was expressed as X.

TABLE 1

| Steel type | Alloy composition (wt %) | | | | | | | |
|---|---|---|---|---|---|---|---|---|
| No. | C | Mn | Cr | Si | Al | P | S | Sn |
| Inventive Steel 1 | 1.02 | 0.41 | 0.35 | 0.22 | 0.03 | 0.011 | 0.003 | 0.22 |
| Comparative Steel 1 | 0.55 | 0.36 | 0.39 | 0.21 | 0.04 | 0.010 | 0.002 | 0.21 |
| Comparative Steel 2 | 1.30 | 0.43 | 0.28 | 0.19 | 0.03 | 0.009 | 0.002 | 0.29 |
| Comparative Steel 3 | 0.98 | 0.11 | 0.23 | 0.23 | 0.03 | 0.011 | 0.002 | 0.35 |
| Comparative Steel 4 | 1.05 | 0.86 | 0.42 | 0.25 | 0.04 | 0.012 | 0.003 | 0.25 |
| Comparative Steel 5 | 0.95 | 0.38 | 0.004 | 0.18 | 0.04 | 0.011 | 0.003 | 0.24 |
| Comparative Steel 6 | 0.97 | 0.39 | 1.12 | 0.22 | 0.03 | 0.009 | 0.002 | 0.26 |
| Comparative Steel 7 | 1.12 | 0.45 | 0.55 | 0.006 | 0.03 | 0.012 | 0.002 | 0.22 |
| Comparative Steel 8 | 1.06 | 0.41 | 0.53 | 0.57 | 0.04 | 0.011 | 0.003 | 0.31 |
| Comparative Steel 9 | 1.04 | 0.40 | 0.48 | 0.31 | 0.007 | 0.011 | 0.002 | 0.28 |
| Comparative Steel 10 | 0.99 | 0.42 | 0.34 | 0.28 | 0.18 | 0.010 | 0.002 | 0.23 |
| Comparative Steel 11 | 1.01 | 0.39 | 0.33 | 0.21 | 0.04 | 0.009 | 0.002 | 0.02 |
| Comparative Steel 12 | 0.97 | 0.41 | 0.32 | 0.20 | 0.04 | 0.01 | 0.002 | 0.65 |

TABLE 2

| Classification | Steel type No. | Finish-rolling temperature (° C.) | Coiling temperature (° C.) | Thickness of hot-rolled steel sheet (mm) | Primary cold rolling reduction ratio (%) | Spheroidizing annealing temperature (° C.) | Spheroidizing annealing time (time) |
|---|---|---|---|---|---|---|---|
| Inventive Example 1 | Inventive Steel 1 | 890 | 640 | 3.0 | 50 | 700 | 20 |
| Inventive Example 2 | Inventive Steel 1 | 870 | 640 | 2.5 | 50 | 710 | 18 |
| Inventive Example 3 | Inventive Steel 1 | 890 | 640 | 2.0 | 45 | 700 | 20 |
| Inventive Example 4 | Inventive Steel 1 | 870 | 630 | 2.2 | 50 | 710 | 18 |
| Comparative Example 1 | Inventive Steel 1 | 890 | 500 | 3.0 | 50 | Occurrence of cracks during primary cold rolling | |

TABLE 2-continued

| Classification | Steel type No. | Finish-rolling temperature (° C.) | Coiling temperature (° C.) | Thickness of hot-rolled steel sheet (mm) | Primary cold rolling reduction ratio (%) | Spheroidizing annealing temperature (° C.) | Spheroidizing annealing time (time) |
|---|---|---|---|---|---|---|---|
| Comparative Example 2 | Inventive Steel 1 | 890 | 740 | 3.0 | 50 | 700 | 20 |
| Comparative Example 3 | Inventive Steel 1 | 890 | 640 | 2.5 | 50 | 610 | 20 |
| Comparative Example 4 | Inventive Steel 1 | 890 | 640 | 2.5 | 50 | 760 | 20 |
| Comparative Example 5 | Inventive Steel 1 | 890 | 640 | 2.5 | 50 | 700 | 6 |
| Comparative Example 6 | Inventive Steel 1 | 890 | 640 | 2.5 | 50 | 700 | 32 |
| Comparative Example 7 | Inventive Steel 1 | 890 | 640 | 2.0 | 45 | 700 | 20 |
| Comparative Example 8 | Inventive Steel 1 | 890 | 640 | 2.0 | 45 | 700 | 20 |
| Comparative Example 9 | Inventive Steel 1 | 890 | 640 | 2.0 | 45 | 700 | 20 |
| Comparative Example 10 | Inventive Steel 1 | 890 | 640 | 2.0 | 45 | 700 | 20 |
| Comparative Example 11 | Inventive Steel 1 | 890 | 640 | 2.0 | 45 | 700 | 20 |
| Comparative Example 12 | Inventive Steel 1 | 890 | 640 | 2.0 | 45 | 700 | 20 |
| Comparative Example 13 | Inventive Steel 1 | 890 | 640 | 2.0 | 45 | 700 | 20 |
| Comparative Example 14 | Inventive Steel 1 | 890 | 640 | 2.0 | 45 | 700 | 20 |
| Comparative Example 15 | Comparative Steel 1 | 890 | 640 | 3.0 | 50 | 700 | 20 |
| Comparative Example 16 | Comparative Steel 2 | 890 | 640 | 3.0 | 50 | 700 | 20 |
| Comparative Example 17 | Comparative Steel 3 | 890 | 640 | 3.0 | 50 | 700 | 20 |
| Comparative Example 18 | Comparative Steel 4 | 890 | 640 | 3.0 | 50 | 700 | 20 |
| Comparative Example 19 | Comparative Steel 5 | 890 | 640 | 3.0 | 50 | 700 | 20 |
| Comparative Example 20 | Comparative Steel 6 | 890 | 640 | 3.0 | 50 | 700 | 20 |
| Comparative Example 21 | Comparative Steel 7 | 890 | 640 | 3.0 | 50 | 700 | 20 |
| Comparative Example 22 | Comparative Steel 8 | 890 | 640 | 3.0 | 50 | 700 | 20 |
| Comparative Example 23 | Comparative Steel 9 | 890 | 640 | 3.0 | 50 | 700 | 20 |
| Comparative Example 24 | Comparative Steel 10 | 890 | 640 | 3.0 | 50 | 700 | 20 |
| Comparative Example 25 | Comparative Steel 11 | 890 | 640 | 3.0 | 50 | 700 | 20 |
| Comparative Example 26 | Comparative Steel 12 | 890 | 640 | 3.0 | 50 | 700 | 20 |

TABLE 3

| Classification | Steel type No. | Secondary cold rolling reduction ratio (%) | Final cold-rolled steel sheet thickness (mm) | Austempering reheating temperature (° C.) | Austempering reheating time (sec) | Austempering heat treatment temperature ° C. (° C.) | Austempering heat treatment time (sec) |
|---|---|---|---|---|---|---|---|
| Inventive Example 1 | Inventive Steel 1 | 40 | 0.90 | 890 | 50 | 410 | 90 |
| Inventive Example 2 | Inventive Steel 1 | 40 | 0.75 | 910 | 60 | 420 | 80 |
| Inventive Example 3 | Inventive Steel 1 | 40 | 0.66 | 890 | 50 | 410 | 90 |

TABLE 3-continued

| Classification | Steel type No. | Secondary cold rolling reduction ratio (%) | Final cold-rolled steel sheet thickness (mm) | Austempering reheating temperature (° C.) | Austempering reheating time (sec) | Austempering heat treatment temperature ° C. (° C.) | Austempering heat treatment time (sec) |
|---|---|---|---|---|---|---|---|
| Inventive Example 4 | Inventive Steel 1 | 45 | 0.61 | 910 | 60 | 420 | 80 |
| Comparative Example 1 | Inventive Steel 1 | Occurrence of cracks during primary cold rolling | | | | | |
| Comparative Example 2 | Inventive Steel 1 | 40 | 0.90 | 890 | 50 | 410 | 90 |
| Comparative Example 3 | Inventive Steel 1 | 40 | 0.75 | 890 | 50 | 410 | 90 |
| Comparative Example 4 | Inventive Steel 1 | 40 | 0.75 | 890 | 50 | 410 | 90 |
| Comparative Example 5 | Inventive Steel 1 | 40 | 0.75 | 890 | 50 | 410 | 90 |
| Comparative Example 6 | Inventive Steel 1 | 40 | 0.75 | 890 | 50 | 410 | 90 |
| Comparative Example 7 | Inventive Steel 1 | 40 | 0.66 | 750 | 60 | 410 | 90 |
| Comparative Example 8 | Inventive Steel 1 | 40 | 0.66 | 1120 | 60 | 410 | 90 |
| Comparative Example 9 | Inventive Steel 1 | 40 | 0.66 | 890 | 5 | 410 | 90 |
| Comparative Example 10 | Inventive Steel 1 | 40 | 0.66 | 890 | 160 | 410 | 90 |
| Comparative Example 11 | Inventive Steel 1 | 40 | 0.66 | 890 | 60 | 240 | 90 |
| Comparative Example 12 | Inventive Steel 1 | 40 | 0.66 | 890 | 60 | 570 | 90 |
| Comparative Example 13 | Inventive Steel 1 | 40 | 0.66 | 890 | 60 | 410 | 18 |
| Comparative Example 14 | Inventive Steel 1 | 40 | 0.66 | 890 | 60 | 410 | 240 |
| Comparative Example 15 | Comparative Steel 1 | 40 | 0.90 | 890 | 50 | 410 | 90 |
| Comparative Example 16 | Comparative Steel 2 | 40 | 0.90 | 890 | 50 | 410 | 90 |
| Comparative Example 17 | Comparative Steel 3 | 40 | 0.90 | 890 | 50 | 410 | 90 |
| Comparative Example 18 | Comparative Steel 4 | 40 | 0.90 | 890 | 50 | 410 | 90 |
| Comparative Example 19 | Comparative Steel 5 | 40 | 0.90 | 890 | 50 | 410 | 90 |
| Comparative Example 20 | Comparative Steel 6 | 40 | 0.90 | 890 | 50 | 410 | 90 |
| Comparative Example 21 | Comparative Steel 7 | 40 | 0.90 | 890 | 50 | 410 | 90 |
| Comparative Example 22 | Comparative Steel 8 | 40 | 0.90 | 890 | 50 | 410 | 90 |
| Comparative Example 23 | Comparative Steel 9 | 40 | 0.90 | 890 | 50 | 410 | 90 |
| Comparative Example 24 | Comparative Steel 10 | 40 | 0.90 | 890 | 50 | 410 | 90 |
| Comparative Example 25 | Comparative Steel 11 | 40 | 0.90 | 890 | 50 | 410 | 90 |
| Comparative Example 26 | Comparative Steel 12 | 40 | 0.90 | 890 | 50 | 410 | 90 |

TABLE 4

| Classification | Microstructure (area %) | | | | Average grain size | Internal oxide layer thickness | Mechanical properties | | | |
|---|---|---|---|---|---|---|---|---|---|---|
| | B | RA | M | F | (μm) | (μm) | Tensile strength (MPa) | Hardness (HRC) | R/t | 180° properties |
| Inventive Example 1 | 90 | 3 | 6 | 1 | 12 | 1 | 1896 | 51 | 0.6 | ○ |
| Inventive Example 2 | 91 | 4 | 4 | 1 | 11 | 2 | 1831 | 49 | 0.7 | ○ |

TABLE 4-continued

| Classification | Microstructure (area %) B | RA | M | F | Average grain size (μm) | Internal oxide layer thickness (μm) | Mechanical properties Tensile strength (MPa) | Hardness (HRC) | R/t | 180° properties |
|---|---|---|---|---|---|---|---|---|---|---|
| Inventive Example 3 | 88 | 4 | 6 | 2 | 8 | 2 | 1924 | 51 | 0.8 | ○ |
| Inventive Example 4 | 90 | 3 | 5 | 2 | 9 | 3 | 1855 | 50 | 0.8 | ○ |
| Comparative Example 1 | — | — | — | — | — | — | — | — | — | — |
| Comparative Example 2 | 80 | 5 | 7 | 8 | 16 | 2 | 1522 | 45 | 1.7 | ○ |
| Comparative Example 3 | 79 | 6 | 6 | 9 | 18 | 2 | 1531 | 46 | 2.0 | ○ |
| Comparative Example 4 | 82 | 5 | 5 | 8 | 21 | 1 | 1543 | 45 | 2.0 | ○ |
| Comparative Example 5 | 82 | 6 | 5 | 7 | 19 | 2 | 1558 | 46 | 2.0 | ○ |
| Comparative Example 6 | 84 | 4 | 4 | 8 | 22 | 2 | 1549 | 46 | 2.7 | ○ |
| Comparative Example 7 | 81 | 5 | 5 | 9 | 16 | 3 | 1516 | 45 | 2.3 | ○ |
| Comparative Example 8 | 90 | 4 | 3 | 3 | 31 | 2 | 1880 | 50 | 3.0 | X |
| Comparative Example 9 | 80 | 5 | 6 | 9 | 17 | 2 | 1522 | 46 | 2.3 | ○ |
| Comparative Example 10 | 90 | 3 | 4 | 3 | 32 | 1 | 1896 | 50 | 3.0 | X |
| Comparative Example 11 | 83 | 2 | 11 | 4 | 17 | 3 | 2075 | 55 | 1.5 | ○ |
| Comparative Example 12 | 85 | 3 | 3 | 9 | 18 | 4 | 1467 | 43 | 1.5 | ○ |
| Comparative Example 13 | 82 | 3 | 3 | 12 | 15 | 2 | 1488 | 44 | 1.5 | ○ |
| Comparative Example 14 | 84 | 11 | 3 | 2 | 13 | 2 | 1866 | 49 | 2.3 | ○ |
| Comparative Example 15 | 81 | 7 | 6 | 6 | 18 | 5 | 1369 | 19 | 0.6 | ○ |
| Comparative Example 16 | 79 | 6 | 8 | 7 | 17 | 2 | 2153 | 56 | 2.2 | ○ |
| Comparative Example 17 | 84 | 6 | 5 | 5 | 16 | 2 | 1521 | 45 | 0.6 | ○ |
| Comparative Example 18 | 82 | 5 | 7 | 6 | 12 | 3 | 2061 | 54 | 1.7 | ○ |
| Comparative Example 19 | 85 | 7 | 5 | 3 | 22 | 2 | 1543 | 46 | 0.6 | ○ |
| Comparative Example 20 | 84 | 4 | 6 | 6 | 13 | 2 | 2107 | 55 | 1.7 | ○ |
| Comparative Example 21 | 79 | 12 | 5 | 4 | 21 | 1 | 1569 | 46 | 1.7 | ○ |
| Comparative Example 22 | 83 | 1 | 12 | 4 | 15 | 2 | 2071 | 55 | 2.2 | ○ |
| Comparative Example 23 | 86 | 4 | 6 | 4 | 29 | 2 | 1872 | 49 | 2.2 | ○ |
| Comparative Example 24 | 82 | 5 | 6 | 7 | 12 | 3 | 2045 | 55 | 2.2 | ○ |
| Comparative Example 25 | 90 | 4 | 5 | 1 | 12 | 19 | 1888 | 50 | 3.0 | X |
| Comparative Example 26 | 89 | 3 | 6 | 2 | 13 | 1 | 1531 | 49 | 3.5 | X |

B: Bainite, RA: Retained austenite, M: Martensite, F: Ferrite

As shown in Tables 1 to 4, in the cases of Inventive Examples 1 to 4 in which all the alloy composition and manufacturing conditions proposed by the present disclosure were satisfied, it could be appreciated that, as the microstructure and the thickness of the internal oxide layer proposed by the present disclosure were satisfied, the tensile strength was 1,600 to 2,000 MPa, the hardness was 47 to 54 HRC, and the R/t was 1.0 or less when measured in the 90° bending test.

In the case of Comparative Example 1 in which the alloy composition of the present disclosure was satisfied, but the hot-rolled coiling temperature was 500° C., which was out of the condition of the present disclosure of 560 to 700° C., it could be appreciated that, as a low-temperature structure such as bainite was formed due to the low coiling temperature, the microstructure in the hot-rolled width direction and the length direction was non-uniform, and thus, crack defects occurred during the primary cold rolling.

In the case of Comparative Example 2 in which the alloy composition of the present disclosure was satisfied, but the hot-rolled coiling temperature was 740° C., which was out of the condition of the present disclosure of 560 to 700° C., it could be appreciated that, as coarse pearlite and carbide layers were formed due to the high coiling temperature, undissolved carbides remained and a coarse structure was formed even after the austempering heat treatment, and as a result, the tensile strength was 1,522 MPa and the R/t was 1.7, which were out of the tensile strength of 1,600 to 2,000 MPa and the R/t of 1.0 or less as the targets of the present disclosure, respectively.

In the case of Comparative Example 3 in which the alloy composition of the present disclosure was satisfied, but the spheroidizing annealing temperature was 610° C., which was out of the condition of the present disclosure of 650 to 740° C., it could be appreciated that, as the pearlite structure remained due to the spheroidizing annealing temperature that was too low, the content of carbon in the matrix structure was reduced even after the austempering heat treatment, and as a result, the tensile strength was 1,531 MPa, which was out of the target of the present disclosure of 1,600 to 2,000 MPa.

In the case of Comparative Example 4 in which the alloy composition of the present disclosure was satisfied, but the spheroidizing annealing temperature was 760° C., which was out of the condition of the present disclosure of 650 to 740° C., it could be appreciated that, as a regenerated pearlite structure was formed after partial recrystallization due to the spheroidizing annealing temperature that was too high, the strength of the bainite structure was reduced after the austempering heat treatment, and as a result, the tensile strength was 1,543 MPa, which was out of the target of the present disclosure of 1,600 to 2,000 MPa.

In the case of Comparative Example 5 in which the alloy composition of the present disclosure was satisfied, but the spheroidizing annealing time was 6 hours, which was out of the condition of the present disclosure of 10 to 25 hours, it could be appreciated that, as the pearlite structure remained due to the spheroidizing annealing time that was too short, the content of carbon in the matrix structure was reduced after the austempering heat treatment, and as a result, the tensile strength was 1,558 MPa, which was out of the target of the present disclosure of 1,600 to 2,000 MPa.

In the case of Comparative Example 6 in which the alloy composition of the present disclosure was satisfied, but the spheroidizing annealing time was 32 hours, which was out of the condition of the present disclosure of 10 to 25 hours, it could be appreciated that, as the formed spherical carbide became coarse due to the spheroidizing annealing time that was too long, the strength and the bending properties were deteriorated due to the presence of undissolved carbides and the reduction in content of carbon in the matrix structure occurring during the austempering heat treatment, and therefore, the tensile strength was 1,549 MPa and the R/t was 2.7, which were out of the targets of the present disclosure of 1,600 to 2,000 MPa and 1.0 or less, respectively.

In the case of Comparative Example 7 in which the alloy composition of the present disclosure was satisfied, but the austempering reheating temperature was 750° C., which was out of the condition of the present disclosure of 800 to 1,000° C., it could be appreciated that the strength was reduced due to insufficient austenizing during the reheating, and as a result, the tensile strength was 1,516 MPa, which was out of the range of the present disclosure of 1,600 to 2,000 MPa.

In the case of Comparative Example 8 in which the alloy composition of the present disclosure was satisfied, but the austempering reheating temperature was 1,120° C., which was out of the condition of the present disclosure of 800 to 1,000° C., it could be appreciated that the coarse grain having a size of 31 μm, which was out of the range of the present disclosure of 3 to 20 μm, was formed during the austenizing, and the bending property R/t was 3.0, which was out of the range of the present disclosure of 1.0 or less.

In the case of Comparative Example 9 in which the alloy composition of the present disclosure was satisfied, but the austempering reheating time was 5 seconds, which was out of the condition of the present disclosure of 10 to 120 seconds, it could be appreciated that the strength was reduced due to insufficient austenizing during the reheating, and as a result, the tensile strength was 1,522 MPa, which was out of the range of the present disclosure of 1,600 to 2,000 MPa.

In the case of Comparative Example 10 in which the alloy composition of the present disclosure was satisfied, but the austempering reheating time was 160 seconds, which was out of the condition of the present disclosure of 10 to 120 seconds, it could be appreciated that the coarse grain having a size of 32 μm, which was out of the range of the present disclosure of 3 to 20 μm, was formed during the austenizing, and the bending property R/t was 3.0, which was out of the range of the present disclosure of 1.0 or less.

In the case of Comparative Example 11 in which the alloy composition of the present disclosure was satisfied, but the austempering heat treatment temperature was 240° C., which was out of the condition of the present disclosure of 300 to 500° C., it could be appreciated that the martensite structure was excessively formed during the heat treatment, and as a result, the tensile strength was 2,075 MPa, which was out of the range of the present disclosure of 1,600 to 2,000 MPa.

In the case of Comparative Example 12 in which the alloy composition of the present disclosure was satisfied, but the austempering heat treatment temperature was 570° C., which was out of the condition of the present disclosure of 300 to 500° C., it could be appreciated that bainite was not sufficiently formed during the heat treatment, and as a result, the tensile strength was 1,467 MPa, which was out of the range of the present disclosure of 1,600 to 2,000 MPa.

In the case of Comparative Example 13 in which the alloy composition of the present disclosure was satisfied, but the austempering heat treatment time was 18 seconds, which was out of the condition of the present disclosure of 30 to 180 seconds, it could be appreciated that, during the heat treatment, bainite was not sufficiently formed and ferrite was formed, and as a result, the tensile strength was 1,488 MPa, which was out of the range of the present disclosure of 1,600 to 2,000 MPa.

In the case of Comparative Example 14 in which the alloy composition of the present disclosure was satisfied, but the austempering heat treatment time was 240 seconds, which was out of the condition of the present disclosure of 30 to 180 seconds, it could be appreciated that, a difference in hardness between phases was caused due to formation of excessive retained austenite, and as a result, the bending property R/t was 2.3, which was out of the range of the present disclosure of 1.0 or less.

In the case of Comparative Example 15 in which the manufacturing conditions of the present disclosure were satisfied, but the content of C was 0.55%, which was out of the range of the present disclosure of 0.8 to 1.25%, it could be appreciated that the content of C was insufficient, and as a result, the tensile strength was 1,369 MPa, which was out of the range of the present disclosure of 1,600 to 2,000 MPa.

In the case of Comparative Example 16 in which the manufacturing conditions of the present disclosure were satisfied, but the content of C was 1.30%, which was out of the range of the present disclosure of 0.8 to 1.25%, it could be appreciated that the content of C was excessive, and as a result, the tensile strength was 1,369 MPa and R/t was 2.2, which were out of the ranges of the present disclosure of 1,600 to 2,000 MPa and 1.0 or less, respectively.

In the case of Comparative Example 17 in which the manufacturing conditions of the present disclosure were satisfied, but the content of Mn was 0.11%, which was out of the range of the present disclosure of 0.2 to 0.6%, it could be appreciated that the content of Mn was insufficient, and as a result, the tensile strength was 1,521 MPa, which was out of the range of the present disclosure of 1,600 to 2,000 MPa.

In the case of Comparative Example 18 in which the manufacturing conditions of the present disclosure were satisfied, but the content of Mn was 0.86%, which was out of the range of the present disclosure of 0.2 to 0.6%, it could be appreciated that the content of Mn was excessive, and as a result, the tensile strength was 2,061 MPa, which was out of the range of the present disclosure of 1,600 to 2,000 MPa, and the bending properties were also deteriorated.

In the case of Comparative Example 19 in which the manufacturing conditions of the present disclosure were satisfied, but the content of Cr was 0.004%, which was out of the range of the present disclosure of 0.1 to 1.0%, it could be appreciated that the solid solution strengthening and hardenability were insufficient due to the insufficient content of Cr, and as a result, the tensile strength was 1,543 MPa, which was out of the range of the present disclosure of 1,600 to 2,000 MPa.

In the case of Comparative Example 20 in which the manufacturing conditions of the present disclosure were satisfied, but the content of Cr was 1.12%, which was out of the range of the present disclosure of 0.1 to 1.0%, it could be appreciated that the content of Cr was excessive, and as a result, the tensile strength was 2,107 MPa, which was out of the range of the present disclosure of 1,600 to 2,000 MPa, and the bending properties were also deteriorated.

In the case of Comparative Example 21 in which the manufacturing conditions of the present disclosure were satisfied, but the content of Si was 0.006%, which was out of the range of the present disclosure of 0.01 to 0.4%, it could be appreciated that the content of Si was insufficient, and as a result, the tensile strength was 1,569 MPa, which was out of the range of the present disclosure of 1,600 to 2,000 MPa.

In the case of Comparative Example 22 in which the manufacturing conditions of the present disclosure were satisfied, but the content of Si was 0.57%, which was out of the range of the present disclosure of 0.01 to 0.4%, it could be appreciated that the content of Si was excessive, and as a result, the tensile strength was 2,071 MPa, which was out of the range of the present disclosure of 1,600 to 2,000 MPa, and the bending properties were also deteriorated.

In the case of Comparative Example 23 in which the manufacturing conditions of the present disclosure were satisfied, but the content of Al was 0.007%, which was out of the range of the present disclosure of 0.01 to 0.1%, it could be appreciated that, as the content of Al was insufficient, the microstructure became coarse during the austempering heat treatment, and as a result, the bending property R/t was 2.2, which was out of the range of the present disclosure of 1.0 or less.

In the case of Comparative Example 24 in which the manufacturing conditions of the present disclosure were satisfied, but the content of Al was 0.18%, which was out of the range of the present disclosure of 0.01 to 0.1%, it could be appreciated that the content of Al was excessive, and as a result, the tensile strength was 2,045 MPa, which was out of the range of the present disclosure of 1,600 to 2,000 MPa, and the bending properties were also deteriorated.

In the case of Comparative Example 25 in which the manufacturing conditions of the present disclosure were satisfied, but the content of Sn was 0.02%, which was out of the range of the present disclosure of 0.05 to 0.5%, it could be appreciated that as the content of Sn was insufficient, the internal oxide layer having a thickness of 19 μm, which was out of the range of the present disclosure of 15 um or less, was formed, and thus, the 90° bending properties and 180° bending properties were deteriorated.

In the case of Comparative Example 26 in which the manufacturing conditions of the present disclosure were satisfied, but the content of Sn was 0.65%, which was out of the range of the present disclosure of 0.05 to 0.5%, it could be appreciated that as the content of Sn was excessive, the strength and toughness were deteriorated due to excessive segregation, and thus, the 90° bending properties and 180° bending properties were deteriorated.

The invention claimed is:

1. A high-carbon cold-rolled steel sheet, comprising, by wt %:

0.80 to 1.25% of C, 0.2 to 0.6% of Mn, 0.01 to 0.4% of Si, 0.005 to 0.02% of P, 0.01% or less of S, 0.01 to 0.1% of Al, 0.01 to 1.0% of Cr, 0.05 to 0.5% of Sn, and a balance of Fe and other unavoidable impurities, wherein a microstructure includes, by area %, 1 to 10% of retained austenite, 1 to 10% of martensite, 5% or less, including 0% of ferrite, and a balance of bainite, an average grain size of the microstructure is 3 to 20 μm, and a thickness of an internal oxide layer formed directly below a surface of the cold-rolled steel sheet is 10 μm or less.

2. The high-carbon cold-rolled steel sheet of claim 1, wherein the cold-rolled steel sheet has a thickness of 0.4 to 2.0 mm.

3. The high-carbon cold-rolled steel sheet of claim 1, wherein the cold-rolled steel sheet has a tensile strength of 1,600 to 2,000 MPa, a hardness of 47 to 54 HRC, and an R/t of 1.0 or less when measured in a 90° bending test.

4. A method for manufacturing a high-carbon cold-rolled steel sheet of claim 1, the method comprising:

heating a slab including, by wt %: 0.80 to 1.25% of C, 0.2 to 0.6% of Mn, 0.01 to 0.4% of Si, 0.005 to 0.02% of P, 0.01% or less of S, 0.01 to 0.1% of Al, 0.01 to 1.0% of Cr, 0.05 to 0.5% of Sn, and a balance of Fe and other unavoidable impurities, rough-rolling the heated slab to obtain a bar;

finish-rolling the bar at 850 to 950° C. to obtain a hot-rolled steel sheet;

cooling the hot-rolled steel sheet to 560 to 700° C. and then coiling the cooled hot-rolled steel sheet;

subjecting the coiled hot-rolled steel sheet to primary cold rolling to obtain a cold-rolled steel sheet;

subjecting the cold-rolled steel sheet to spheroidizing annealing at 650 to 740° C. for 10 to 25 hours;

subjecting the spheroidized-annealed cold-rolled steel sheet to secondary cold rolling;

reheating the cold-rolled steel sheet subjected to the secondary cold rolling at 800 to 1,000° C. for 10 to 120 seconds; and quenching the reheated cold-rolled steel sheet to 300 to 500° C. and then maintaining the quenched cold-rolled steel sheet for 30 to 180 seconds to form the high-carbon cold-rolled steel sheet.

5. The method for manufacturing the high-carbon cold-rolled steel sheet of claim 4, wherein the heating of the slab is performed at 1,100 to 1,300° C.

6. The method for manufacturing the high-carbon cold-rolled steel sheet of claim 4, wherein the rough-rolling is performed at 1,000 to 1,100° C.

7. The method for manufacturing the high-carbon cold-rolled steel sheet of claim 4, wherein the hot-rolled steel sheet has a thickness of 2.0 to 4.0 mm.

8. The method for manufacturing the high-carbon cold-rolled steel sheet of claim 4, wherein the cooling is performed at a cooling rate of 5 to 50° C./s.

9. The method for manufacturing the high-carbon cold-rolled steel sheet of claim 4, further comprising, after the coiling, pickling the coiled hot-rolled steel sheet at 200° C. or lower.

10. The method for manufacturing the high-carbon cold-rolled steel sheet of claim 4, wherein a reduction ratio during the primary cold rolling is 30 to 60%.

11. The method for manufacturing the high-carbon cold-rolled steel sheet of claim 4, wherein a reduction ratio during the secondary cold rolling is 30 to 50%.

12. The method for manufacturing the high-carbon cold-rolled steel sheet of claim 4, wherein a cooling rate during the quenching is 10 to 50° C./s.

* * * * *